United States Patent [19]

Ouellette

[11] Patent Number: 4,765,162

[45] Date of Patent: Aug. 23, 1988

[54] WASHER-DRYER APPARATUS

[76] Inventor: Raymond Ouellette, R.F.D. 1, Box 814A, Bath, Me. 04530

[21] Appl. No.: 83,150

[22] Filed: Aug. 10, 1987

[51] Int. Cl.[4] ..... D06F 25/00; D06F 58/04

[52] U.S. Cl. ..... 68/20

[58] Field of Search ..... 68/20, 139, 142, 19.2

[56] References Cited

U.S. PATENT DOCUMENTS

| | | | |
|---|---|---|---|
| 2,555,268 | 5/1951 | Chamberlin | 68/20 |
| 2,579,761 | 12/1951 | Schmidtke | 68/139 |
| 2,868,004 | 1/1959 | Runde | 68/19.2 X |
| 3,006,176 | 10/1961 | Behrens | 68/142 X |
| 3,480,315 | 11/1969 | Wolverton | 68/139 X |

FOREIGN PATENT DOCUMENTS

| | | | |
|---|---|---|---|
| 81635 | 6/1956 | Netherlands | 68/20 |

*Primary Examiner*—Philip R. Coe

*Attorney, Agent, or Firm*—Leon Gilden

[57] ABSTRACT

A compact washer-dryer apparatus wherein a washing and drying cycle typically performed on clothes is set forth utilizing a common rotating drum for each operation. Directed drying air is provided to the common drum by means of an overlying plenum chamber. Subsequent to a washing cycle, a pivoting shielding plate is repositioned whereupon the drying cycle may commence in the common drum utilized for the washing cycle.

6 Claims, 1 Drawing Sheet

WASHER-DRYER APPARATUS

BACKGROUND OF THE INVENTION

1. Field of the Invention

The present invention relates to washing and drying apparatus and more particularly to a new and improved washer-dryer utilizing a single drum to provide both a washing and drying cycle in sequential operations. A compact unit is thereby provided.

2. Description of the Prior Art

The use of washing and drying apparatus is well known in the prior art. As may be appreciated, these devices in the past have required a substantial amount of space and as such, have been bulky devices requiring more room then is necessary with my improved invention. There have been attempts to develop washing and drying apparatus of more compact structure. One example is U.S. Pat. No. 2,793,518 to Geldhof where a washer and dryer performs in a single cabinet-like structure but in a stacked arrangement. The advantage of the Geldhof patent has been to utilized vertical space rather than horizontal space but as such, a duplication of parts and use of space has resulted. A further patent to Geldhof was issued in U.S. Pat. No. 2,834,121 as a somewhat improvement over the aforenoted Geldhof patent. An improved reorientation of motor and pump means as well as other mechanisms provided a somewhat more compact structure, but generally this patent continued the same shortcomings as the previous Geldhof patent in utilizing stacked chambers to provide a washer-dryer combination.

U.S. Pat. No. 3,514,330 to Schaap, et al., sets forth a multi-purpose kitchen unit wherein a sink overlies a dishwashing unit incorporating therewith a garbage disposal unit. This reference does tend to forward the teaching of multi-use single cabinet organizations, however, the single rotating drum for multiple washing and drying operations has accordingly eluded the prior art.

U.S. Pat. No. 3,986,891 to Rumbaugh sets forth a further multi-purpose kitchen appliance. Particularly a cooking and washing combination of unique interrelationship is set forth in somewhat the same vein as the Schaap patent setting forth the teaching of a multi-purpose appliance.

U.S. Pat. No. 4,207,683 to Horton sets forth a conventional-type clothes dryer with the addition, however, of providing a limited spray of water onto the clothes to provide for removal of wrinkles of particular fabrics. The teaching in this patent enables the use of a source for introduction of various liquid additives for use as clothes softening agents and the like and is a further step in enhancing the multi-purpose use of a clothes dryer.

U.S. Pat. No. 4,345,609 to Nishizawa provides an apparatus for the rinsing and drying of small glass tubes such as used in chemical analysis. A cage mounted in a cabinet-like vessel is provided with heating elements whereupon piped in water allows a rinse cycle and the drying elements provide subsequent drying of the contents positioned within the apparatus.

The problem, however, of providing a compact washer-dryer combination for a complete washing and drying operation upon clothes has not been addressed by the prior art. As such it may be appreciated that there is continuing need for new and improved washing and drying apparatus as applied to conventional clothing which addresses both the problem of storage and affectiveness and in this respect, the present invention substantially fulfills this need.

SUMMARY OF THE INVENTION

In view of the foregoing disadvantages inherent in the known types of washer-dryer apparatus now present in the prior art, the present invention provides an improved washer-dryer apparatus. As such, the general purpose of the present invention, which will be described subsequently in greater detail, is to provide a new and improved washer-dryer apparatus which has all the advantages of the prior art washer-dryer apparatus and none of the disadvantages.

To attain this, the present invention comprises a washing and drying combination formed in a unitary cabinet-like structure whereupon a single drum is utilized to perform both the washing and drying function of the apparatus. A shielding mechanism is utilized to protect the heat transporting duct work associated with the drying function from liquid intrusion during the washing cycle and is repositionable outwardly of said duct work to enable a drying cycle to commence.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciated that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved washer-dryer apparatus which has all the advantages of the prior art washer-dryer apparatus and none of the disadvantages.

It is another object of the present invention to provide a new and improved washer-dryer which may be easily and efficiently manufactured and marketed.

It is a further object of the present invention to provide a new and improved washer-dryer apparatus which is of a durable and reliable construction.

An even further object of the present invention is to provide a new and improved washer-dryer apparatus which is susceptible of a low cost of manufacture with regard to both materials and labor, and which accordingly is then susceptible of low prices of sale to the consuming public, thereby making such washer-dryer apparatus economically available to the buying public.

Still yet another object of the present invention is to provide a new and improved washer-dryer apparatus which provides in the apparatuses and methods of the prior art some of the advantages thereof, while simultaneously overcoming some of the disadvantages normally associated therewith.

Still another object of the present invention is to provide a new and improved washer-dryer apparatus formed within a unitary cabinet-like structure.

Still another object of the present invention is to provide a new and improved washing and drying apparatus wherein a single drum member is utilized to perform both the washing and drying cycle of the invention.

A still further object of the present invention is to provide a new and improved washer-dryer apparatus utilizing 110 AC voltage to drive the motor mechanisms of the apparatus and deriving 220 AC voltage to provide power to the heating elements of my invention, all of which are housed in a single, cabinet-like structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
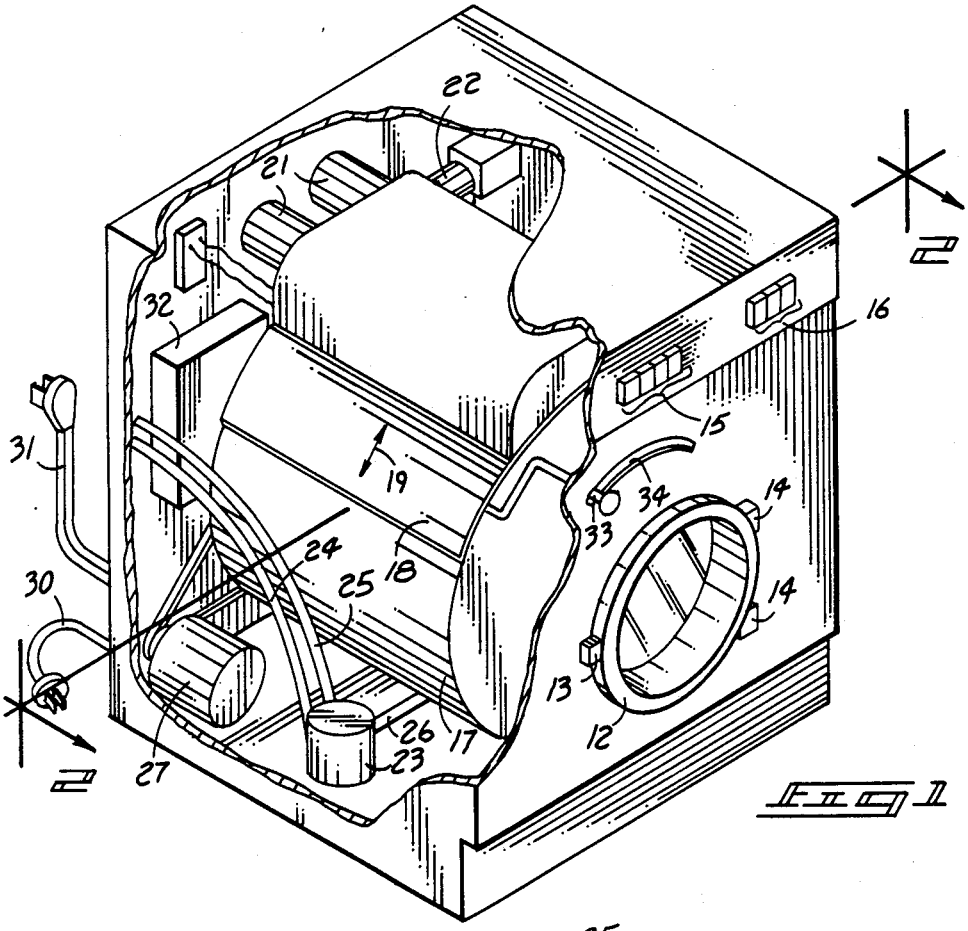
FIG. 1 is an isometric view of my invention in partial cutaway section to provide illustration of the internal components, their configuration and relationship.

With reference now to the drawings, and in particular to FIG. 1 thereof, a new and improved washer-dryer apparatus embodying the principals and concepts of the present invention and generally designated by the reference numeral 10 will be described.

More specifically, it will be noted that the washer-dryer combination sets forth a conventional cabinet-like structure housing essential components of my invention. A forward face 11 is supported thereon with an access door 12 secured by a latch member 13 to a forward face 11 and pivotal about hinge members 14 for gaining access to the interior of the combination washer-dryer drum structure. It is contemplated that separate controls, as typically indicated by washer control buttons 15 and dryer control buttons 16, be positioned for control of the respective functions of my device and the respective washer and dryer control buttons be separated in a manner as to be non-confusing to a user.

With further reference to FIG. 1, it will be noted that a stationary drum 17 is positioned somewhat centrally of the invention 10. Drum 17 has, in sliding relationship thereto, a baffle plate member 18 mounted circumferentially of drum 17 for circumferential reciprocation in the direction of arrow 19 for whose purpose will be described below. Positioned in overlying relationship to drum 17 is an air plenum member 20 with heat supply ducts 21 providing the heated drying air required for the drying function of my invention. Of conventional construction is a vent duct 22 for the normal venting of such drying air, as expended during the drying cycle.

A fluid pump 23 is securedly located upon on the floor portion of my invention with conventional hot water and cold water conduits 24 and 25 respectively providing necessary water to the wash cycle of my invention with an appropriate supply channel 26 to provide a mixture of the input water into the inner rotatable drum of my invention set forth as element 28 in a manner well known in the art of washing machines. Electrical drive motor 27 is positioned for driving of the inner rotatable drum member 28 in a controlled manner dependent upon the need for a wash or dry cycle. Integrally mounted within rotatable drum 28 are agitator fins 29 for the control movement of garments within drum 28.

Gaining access to my invention rearwardly of my apparatus 10 is a provision for plural voltage supply lines. Supply line 30 is a conventional 110 AC volt supply line for normal operation of the motor and its function during a wash cycle. Supply line 31 is a 220 volt supply line utilized should the dryer be constructed as an electrical dryer with the use of electrical resistance heating elements which would be positionable within supply ducts 21 for convenience but may be positionable in any portion of a supply conduit of the heat supply assembly. My washer-dryer apparatus may, of course, utilize natural gas for drying whereupon in lieu of a 220 volt supply line for supplying energy to a heating assembly, gas flame porting would be positioned within the aforenoted drying assembly. An electrical control box 32 may house all of the requisite electrical circuitry which is of conventional configuration well known in the art and accordingly further detail is not deemed necessary.

Figure 2:
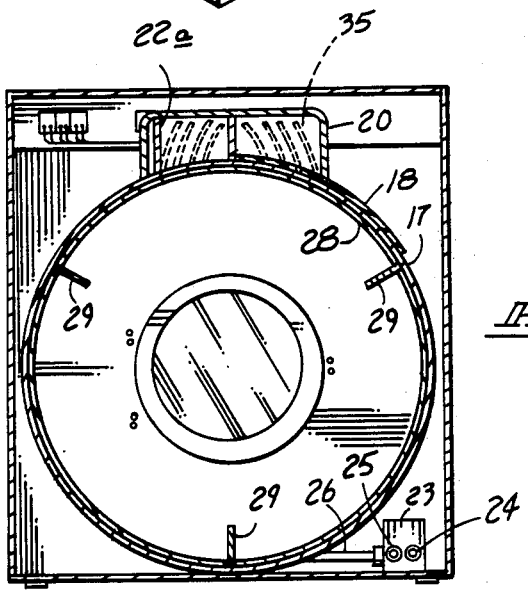
FIG. 2 is an orthographic view of my invention taken along lines 2—2 of FIG. 1 in the direction indicated by the arrows.

Reciprocation of baffle 18 in a direction as indicated by arrow 19 effected by manipulated use of handle 33 displaceable in an arcuate path within arcuate slot 34 positioned for convenience through forward face 11 of my apparatus. When a wash cycle of my invention is utilized handle 33 is grasped and manipulated in a clockwise manner to thereby seal plenum member 20 from the action of fluid within rotatable drum 28. Upon use of a drying cycle of my invention, baffle 18 may be manipulated in a counter clockwise manner to thereby open plenum 28 and provide thereby heated air to interior of rotatable drum 28 when performing its function as a dryer. An alternative to the use of baffle 18 would involve alternate structure, such as the employment of vanes 35 illustrated in phantom in FIG. 2. The vanes 35 would function as not only directional elements for uniform distribution of heated air within rotatable drum 28 during its drying cycle, but would further deflect water during a wash cycle occuring within drum 28 and prevent excess washing liquid from intruding within plenum 20.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved washer-dryer combination comprising, a housing, and a rotatable drum positioned within said housing, and a fluid supply means for providing washing fluid to said portable drum, and an elongate heated air plenum supply means positioned within said housing and overlying said rotatable drum for supplying heated drying air to said rotatable drum, and control means for utilizing either a washing cycle in said drum utilizing a fluid supply from said fluid means or a drying cycle for utilizing heated drying air from said plenum to dry garments positioned within said drum, and a baffle plate means positioned for circumferential motion about said rotatable drum from a first to a second position for enabling drying air to be provided to said drum during said drying cycle in said first position and upon repositioning said baffle plate means to said second position to seal said plenum supply means from fluid intrusion from said drum during said washing cycle; and wherein said baffle plate means is overlying said rotatable drum and underlying said plenum supply means in said second position, and an articulate movable handle integrally secured to said baffle plate means positioned through said housing for enabling positioning of said baffle plate means relative to said plenum means.

2. A new and improved washer-dryer combination as set forth in claim 1 wherein vanes are positioned within said plenum to direct heated air to the interior of said drum and to further prevent washing fluid when utilized within said drum from excessive intrusion into said plenum.

3. A new and improved washer-dryer housing as set forth in claim 1 wherein plural power supply means are provided of various electricaI potentials to provide power to drive said drum and also provide power to utilize heating elements enabling heating of said drying air utilized by said plenum means.

4. A washer-dryer apparatus as set forth in claim 1 wherein plural controls are utilized for independent control of said washing cycle of said apparatus and drying cycle of said apparatus.

5. A washer-dryer apparatus as set forth in claim 1 wherein said drum includes an exterior stationary drum and an interior rotatable drum.

6. A washer-dryer apparatus as set forth in claim 1 wherein venting means is provided in cooperation with said plenum means to vent and exhaust, said heated drying air.

* * * * *